US006641133B2

(12) United States Patent
Mutschall et al.

(10) Patent No.: US 6,641,133 B2
(45) Date of Patent: Nov. 4, 2003

(54) DELIVERY FOR A SHEET-PROCESSING MACHINE

(75) Inventors: Stefan Mutschall, Walldorf (DE); Bettina Remarque, Angelbachtal (DE); Martin Buschmann, Mannheim (DE); Roland Hirth, Römerberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/071,925

(22) Filed: Feb. 7, 2002

(65) Prior Publication Data

US 2002/0109286 A1 Aug. 15, 2002

(30) Foreign Application Priority Data

Feb. 7, 2001 (DE) ..... 101 05 374

(51) Int. Cl.[7] ..... B65H 29/04

(52) U.S. Cl. ..... 271/204; 271/280; 271/300; 271/303

(58) Field of Search ..... 271/204, 280, 271/300, 303

(56) References Cited

U.S. PATENT DOCUMENTS

| | | | | |
|---|---|---|---|---|
| 5,351,946 A | * | 10/1994 | Kamoda et al. | 271/206 |
| 5,568,919 A | * | 10/1996 | Detmers et al. | 271/183 |
| 5,640,908 A | * | 6/1997 | Schaede | 101/484 |
| 5,649,483 A | | 7/1997 | Mack et al. | |
| 6,039,317 A | * | 3/2000 | Kramer | 271/204 |
| 2002/0140166 A1 | * | 10/2002 | Kelm et al. | 271/300 |

FOREIGN PATENT DOCUMENTS

| | | | | |
|---|---|---|---|---|
| DE | 3732589 A1 | * | 9/1988 | B65H/3/48 |
| DE | 195 19 374 A1 | | 11/1996 | |
| DE | 100 49 181 A1 | | 5/2001 | |
| DE | 100 53 162 A1 | | 5/2001 | |
| EP | 599219 A1 | * | 6/1994 | B65H/29/04 |
| JP | 58 047 749 A | | 3/1983 | |
| JP | 63282041 A | * | 11/1988 | B65H/29/04 |
| JP | 64 000 294 A | | 1/1989 | |

* cited by examiner

*Primary Examiner*—Donald P. Walsh
*Assistant Examiner*—Kaitlin Joerger
(74) *Attorney, Agent, or Firm*—Laurence A. Greenberg; Werner H. Stemer; Ralph E. Locher

(57) ABSTRACT

A delivery for a sheet-processing machine for keeping the extent thereof required downline from the delivery pile as short as possible, includes a frame and grippers revolvable, during operation, along a gripper path within the frame. The grippers seize sheets at a location on the gripper path and drag the sheet along sections of the gripper path in a transport direction. A first switching element is provided, for defining a first end of a first one of the sections of the gripper path located downline with respect to the transport direction. A second switching element defines a second end of a second section of the gripper path located downline with respect to the end of the first section. The first switching element is provided on the frame, and the second switching element is provided on a guide part fixed to the frame, and serves for determining a section of a course of the gripper path.

12 Claims, 5 Drawing Sheets

DELIVERY FOR A SHEET-PROCESSING MACHINE

BACKGROUND OF THE INVENTION

Field of the Invention

The invention relates to a delivery for a sheet-processing machine, having a frame, grippers which, during operation, revolve along a gripper path within the frame, and grip a respective sheet at a location on the gripper path and drag the sheet along sections of the gripper path in a transport direction, a first switching element, by which a first end of a first one of the sections of the gripper path, which is disposed downline with respect to the transport direction, is definable, and a second switching element, by which a second end of a second one of the sections of the gripper path, which is disposed downline with respect to the end of the first section, is definable.

A delivery of the aforementioned type is disclosed in the published Japanese Patent Document JP Sho 64-294 B2. The first switching element provided therein defines a first end of a first section of the gripper path, disposed downline with respect to the transport direction, inasmuch as, in the switching position thereof at this end, it opens grippers which drag a sheet along this first section of the gripper path specifically in order to release the sheets, which are dragged along this first section of the gripper path, in order to form a delivery pile.

The second switching element of the heretofore known delivery is located downline from the first switching element, with respect to the transport direction, and defines a second end of a second section of the gripper path, disposed downline from the first end of the first section of the gripper path, disposed downline, inasmuch as, in an ineffective position of the first switching element, it releases the sheets, in this case, dragged by the grippers as far as the aforementioned second end while opening the grippers at this second end, so that the sheets released thereat shoot out beyond the delivery pile and, in the heretofore known delivery, with guidance by sheet guide brackets, are supplied to a deposit container which is located downline from the delivery pile and into which, in this way, proof sheets or rejects are led.

The second switching element of the heretofore known delivery can be adjusted to different switching positions along the gripper path within a specific region of the latter in order to be able to adapt the point of release, for example, of proof sheets, to the machine speed. However, this region is located in a rectilinear section of the gripper path. One reason for this is apparent in that the physical position of the sheets released with the aid of the second switching element is supposed to be maintained independently of the location of the release thereof, apart from a change in location.

However, as implemented in the heretofore known delivery, this necessarily makes it possible for a curved region, which deflects the gripper path and through which the grippers pass on the return path thereof to the location for gripping further sheets, to be provided only at a specific minimum distance from the adjustment region of the second switching element. This has an effect upon the overall length of the heretofore known delivery inasmuch as the deflection region of the gripper path is located considerably farther downline than the side face of the delivery pile which is directed downwardly.

SUMMARY OF THE INVENTION

It is accordingly an object of the invention to provide a delivery for a sheet-processing machine of the general type described in the introduction hereto, which is configured so that the extent thereof required downline from the delivery pile can be kept as short as possible.

With the foregoing and other objects in view, there is provided, in accordance with the invention, in a sheet-processing machine, a delivery comprising a frame, grippers revolvable, during operation, along a gripper path within the frame, the grippers serving for seizing a respective one of the sheets at a location on the gripper path and for dragging the sheet along sections of the gripper path in a transport direction, a first switching element, by which a first end of a first one of the sections of the gripper path, disposed downline with respect to the transport direction, is definable, and a second switching element, by which a second end of a second section of the gripper path, disposed downline with respect to the end of the first section, is definable, the first switching element being disposed on the frame, and the second switching element being disposed on a guide part fixed to the frame, and serving for determining a section of a course of the gripper path.

In accordance with another feature of the invention, the switching elements are adjustable between a respective switching position and a respective ineffective position, and the reverse.

In accordance with a further feature of the invention, one of the two switching elements is in the switching position thereof when the other of the two switching elements is adjusted into the ineffective position thereof, and the reverse.

In accordance with an added feature of the invention, the first switching element is adjustable from the respective switching position thereof into the respective ineffective position by being liftable with respect to the gripper path, and the second switching element being adjustable from the respective switching position into the respective ineffective position by being movable laterally off the gripper path.

In accordance with an additional feature of the invention, the delivery includes a coupling mechanism attached to the frame, the coupling mechanism having a coupler forming the first switching element.

In accordance with yet another feature of the invention, the coupling mechanism includes a first rocker pivotable about a locally fixed, first geometric axis, and a second rocker pivotable about a second geometric axis and having a position that is adjustable.

In accordance with yet a further feature of the invention, the second geometric axis is adjustable to geometric locations on a circular path.

In accordance with yet an added feature of the invention, the delivery includes a pivot arm attached to the guide part and carrying the second switching element.

In accordance with yet an additional feature of the invention, the switching elements are connected kinematically to one another.

In accordance with still another feature of the invention, the delivery includes a spring for biasing the second switching element with an actuating force in a direction towards the switching position thereof, and a control cam adjustable while the first switching element is being adjusted, and by which the second switching element is adjustable from the switching position thereof into the ineffective position thereof counter to the actuating force and, under the action of the actuating force, is adjustable from the ineffective position thereof into the switching position thereof.

In accordance with still a further feature of the invention, the frame has a side wall.

In accordance with a concomitant feature of the invention, the guide part is a deflection rail arrangement.

Thus, the object of the invention is achieved by disposing the first switching element on the frame, and disposing the second switching element on a guide part that is fixed to the frame and that determines a section of the course of the gripper path.

This construction ensures, on the one hand, that the release of the sheets by the revolving grippers, which can be triggered by the first switching element, always takes place at the end of a first section of the gripper path, which can be matched with or adjusted to the formation of the delivery pile, and it is thereby possible, on the other hand, for the end of the second section of the gripper path, i.e., the location at which the corresponding release of the sheets, which can be triggered by the second switching element, takes place, in particular with respect to a deflection region of the gripper path, which follows the end of this second section, to always be at one and the same location. The release of the sheets, which can be triggered by the second switching element, can thus be provided in particular at a location which lies in the aforementioned deflection region without any change resulting in the physical position of the sheets at the instant at which they are released, in case of a displacement, required, in particular, to retension chains normally used to transport the grippers, of the deflection region, besides a change in the release location. Maintaining the aforementioned physical position is an important precondition for proper transfer of a sheet released by the grippers to a transport device which, for example, includes revolving belts which brake the sheets, and by which the sheets are supplied to a deposit for proof sheets or rejects which is placed downline from the delivery pile with respect to the transport direction. In addition to the intended shortening of an extent of the delivery provided beyond the delivery pile, the configuration of the delivery according to the invention also satisfies the aforementioned precondition.

Other features which are considered as characteristic for the invention are set forth in the appended claims.

Although the invention is illustrated and described herein as embodied in a delivery for a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

With a delivery of the type mentioned in the introduction hereto, in particular, a sheet-processing printing machine can be operated in a first operating state wherein the processed sheets, which are printed sheets in this case, are stacked in a pile before further processing and, generally briefly, in a second operating state wherein, for example, for documentation or other purposes, sheets are removed beyond a corresponding stacking or pile-forming station.

DESCRIPTION OF THE PREFERRED EMBODIMENTS

Figure 1:
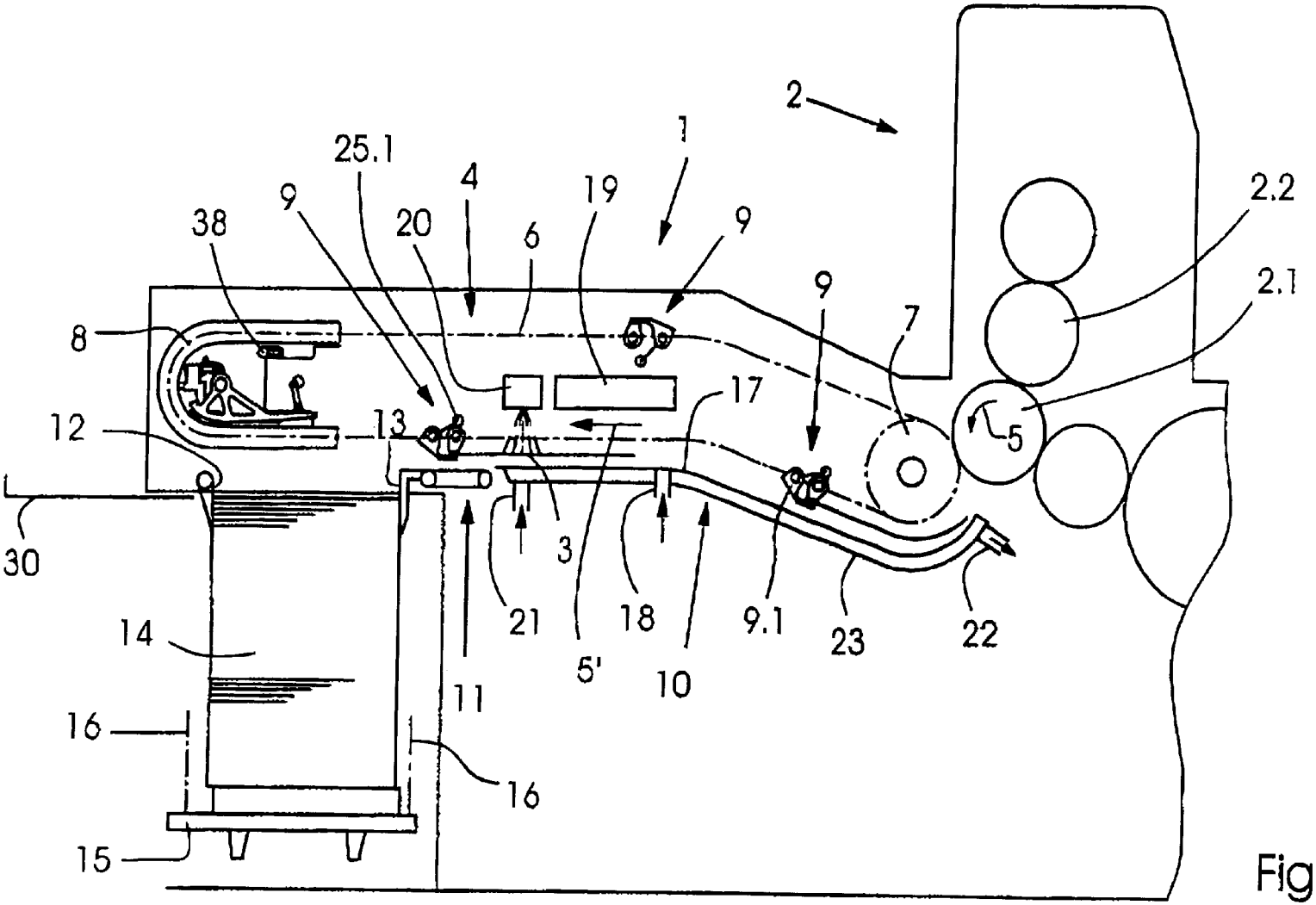
FIG. 1 is a fragmentary diagrammatic side elevational view of a sheet-processing machine, such as a rotary printing machine, for example, showing a section thereof which includes a delivery.

Referring now to the drawings and, first, particularly to FIG. 1 thereof, there is shown therein a delivery 1 of this general type following a last processing station of the printing machine. Such a processing station can be a printing unit or a post-treatment unit, such as a varnishing unit. In the example at hand, the last processing station is a printing unit 2 operating in accordance with the offset process and having an impression cylinder 2.1. The latter carries and conveys a respective sheet 3 in a processing direction represented by an arrow 5, which also represents the direction of rotation of the impression cylinder 2.1, through a printing nip formed between the impression cylinder 2.1 and a blanket cylinder 2.2 cooperating therewith, and then transfers the sheet 3 to a chain conveyor 4 while opening grippers, which are arranged on the impression cylinder 2.1 and provided for gripping the sheet 3 at a gripper edge located at the leading end of the sheet 3. The chain conveyor 4 includes two conveyor chains 6, a respective one thereof, in operation, revolving along an inner side of a side wall of the delivery 1, respectively, associated with a frame of the delivery 1. A respective conveying chain 6 wraps around each of two synchronously driven drive sprockets 7 having axes of rotation which are aligned with one another, and is guided over a deflection rail device or arrangement 8, respectively located downline from the drive sprockets 7, as viewed in the processing direction represented by the arrow 5'. Between the two conveyor chains 6, there extend gripper systems 9, borne by the chains 6, the gripper systems 9 including automatically closing grippers 9.1 which thus, in operation, pass along a closed gripper path and through gaps between the grippers which are mounted on the impression cylinder 2.1 and, in the process, accept a respective sheet 3, by gripping the aforementioned gripper edge at the leading end of the sheet 3, directly before the grippers mounted on the impression cylinder 2.1 open. The grippers 9 then drag the gripped sheet 3 in the transport direction 5' over a sheet guide device 10 to a sheet brake 11, is and open thereat in a switching position of a first switching element, explained herein in due course, in order to transfer the sheet 3 to the sheet brake 11. The latter imparts to the sheet 3 a deposit speed which is reduced with respect to the processing speed and, after the sheet 3 has reached the deposit speed, in turn, releases it so that a respective, now retarded sheet 3 finally strikes leading-edge stops 12. The sheet 3, thus now aligned on the leasing-edge stops 12 and on trailing-edge stops 13 located opposite thereto, together with preceding and/or following sheets 3, forms a sheet pile 14, which can be lowered by a lifting mechanism to the same extent as the sheet pile 14 grows. Of the lifting mechanism, FIG. 1 reproduces only a platform 15, which carries the pile 14, and lifting chains 16, which carry the platform 15 and are shown in phantom.

The conveyor chains 6 extending along the path thereof between the drive sprockets 7, on the one hand, and the deflection rail device 8, on the other hand, are guided by further chain guide rails (not shown here), which thus determine the chain paths of the chain strands and, consequently, the course of the gripper path. In the example at hand, the sheets 3 are transported by the lower chain strand in FIG. 1. The section of the chain path through which the lower chain strand passes is followed alongside by a sheet guide surface 17 which faces that section of the chain path and is formed on the sheet guide device 10. In operation, a cushion of carrying air is preferably formed between the sheet guide surface 17 and the sheet 3, respectively, guided thereover. For this purpose, the sheet guide device 10 is equipped with blast or blowing-air nozzles which open into the sheet guide surface 17 and of which, in FIG. 1, only one is shown as representative of all thereof, in a symbolic representation in the form of a nozzle 18.

In order to prevent mutual adherence or sticking of the printed sheets 3 in the pile 14, a dryer 19 and a powdering device 20 are provided on the path of the sheets 3 from the drive sprockets 7 to the sheet brake 11.

To avoid excessive heating of the sheet guide surface 17 by the dryer 19, a coolant circuit or loop is integrated into the sheet guide device 10, and is indicated symbolically in FIG. 1 by an inlet nozzle 21 and an outlet nozzle 22 for a coolant trough 23 associated with the sheet guide surface 17.

The action of opening the automatically closing grippers 9.1 in order to transfer the sheet 3 to the sheet brake 11 is carried out by the aforementioned first switching element 24. For this purpose, a respective one of the gripper systems 9 is provided with a roller lever device 25 (note FIG. 2) having a roller 25.1, by which, when actuated in the appropriate direction, the normally closed grippers 9.1 can be displaced into an opened condition. In addition, the first switching element 24 has a switching surface 24.1 arranged in such a way that the roller 25.1 makes contact with the aforementioned switching surface 24.1 in a switch position of the first switching element 24, and opens the grippers 9.1 of a respective gripper system 9 when the respective gripper system 9, as it revolves along the gripper path, reaches a location on the gripper path that is determined by the location and position of the first switching element 24. This location then determines a first end of a first section A1 of the gripper path, disposed downline with respect to the transport direction 5' of the sheets, facing towards the pile 14, along which path the sheet 3 released by the grippers 9.1 at this location is dragged in the transport direction 5' by the grippers 9.1, after the grippers 9.1 have gripped the sheet at a location on the gripper path disposed upline with respect to this transport direction, and accepted the sheet from the impression cylinder 2.1.

Figure 2:
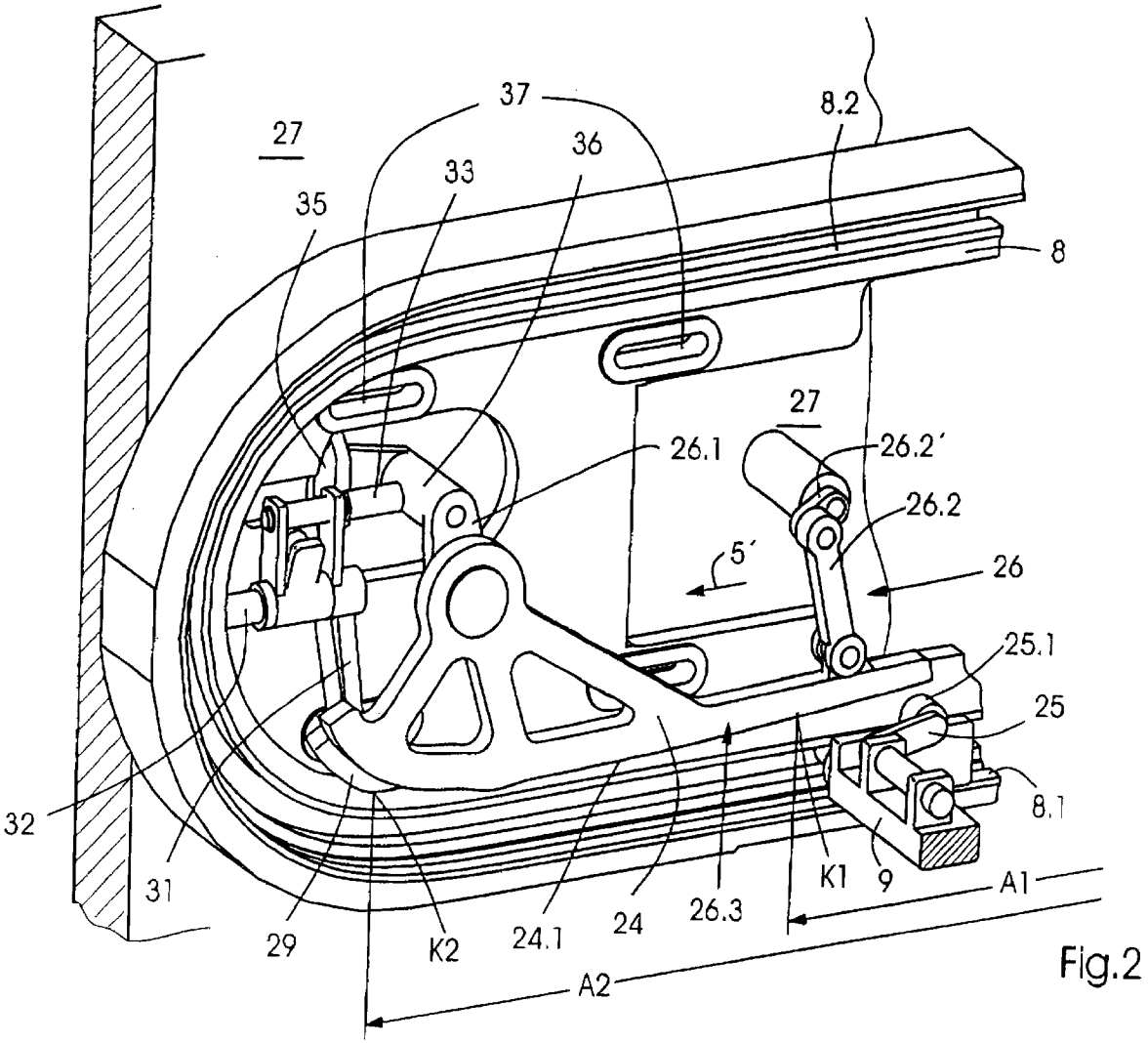
FIG. 2 is an enlarged fragmentary, front, side and top perspective view of FIG. 1 showing an end section of the delivery disposed well downline with respect to the transport direction.

As FIG. 2 reveals, the first switching element 24 is preferably constructed in the form of a couple 26.3 of a coupling mechanism 26 having a first rocker 26.1 and a second rocker 26.2, of which the first rocker 26.1 is disposed downline from the second rocker 26.2 with respect to the transport direction 5'. In this case, the joints fixed to the frame and required, amongst others, to form the coupling mechanism 26 are assigned to a side wall 27 associated with the frame of the delivery 1.

Figure 3:
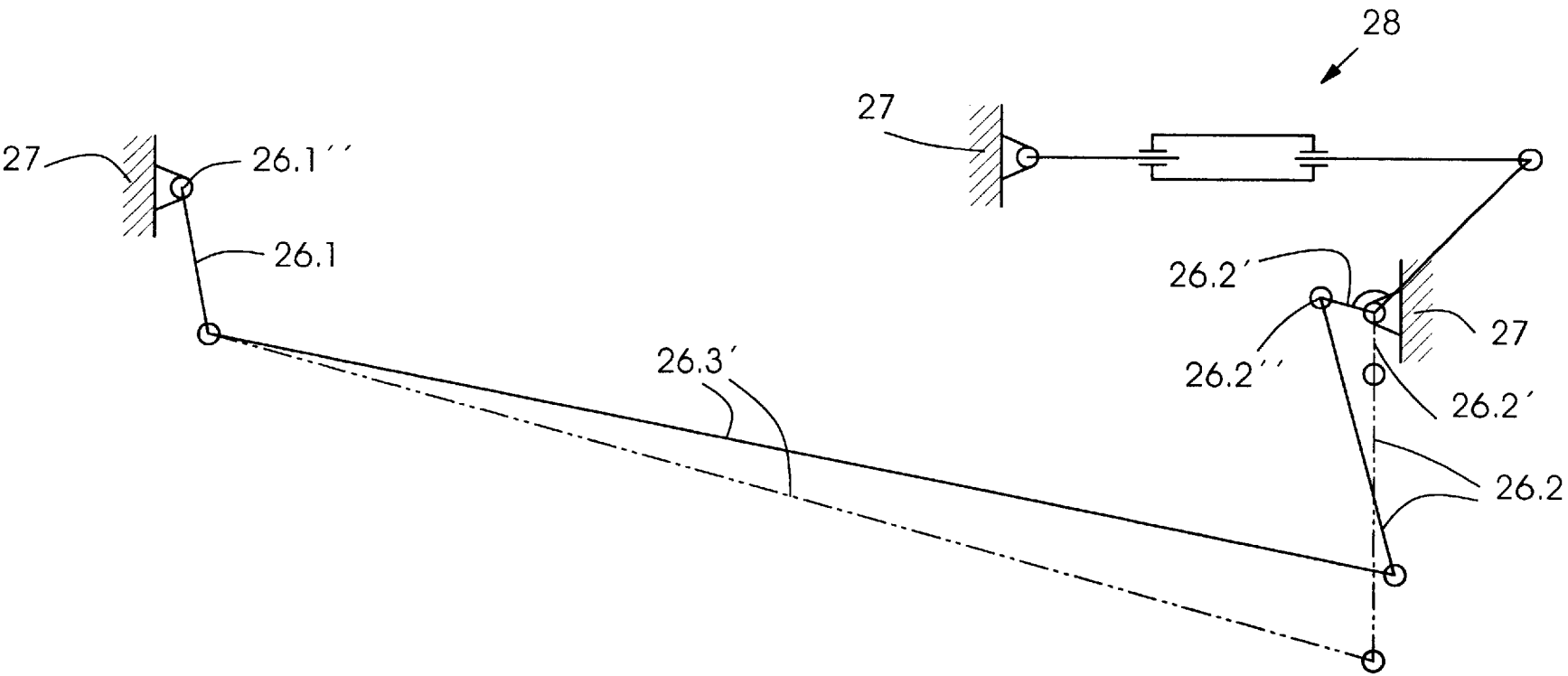
FIG. 3 is a schematic and diagrammatic view of a first divider gear mechanism, by which the first switching element is adjustable within a switching region disposed between two switching positions, which serve for determining the shortest and the longest extent of the first section of the gripper path, up to the downline end of which the sheets are dragged by the grippers, together with an example of an adjusting device by which the first switching element is adjustable within the aforementioned switching region.
Figure 4:
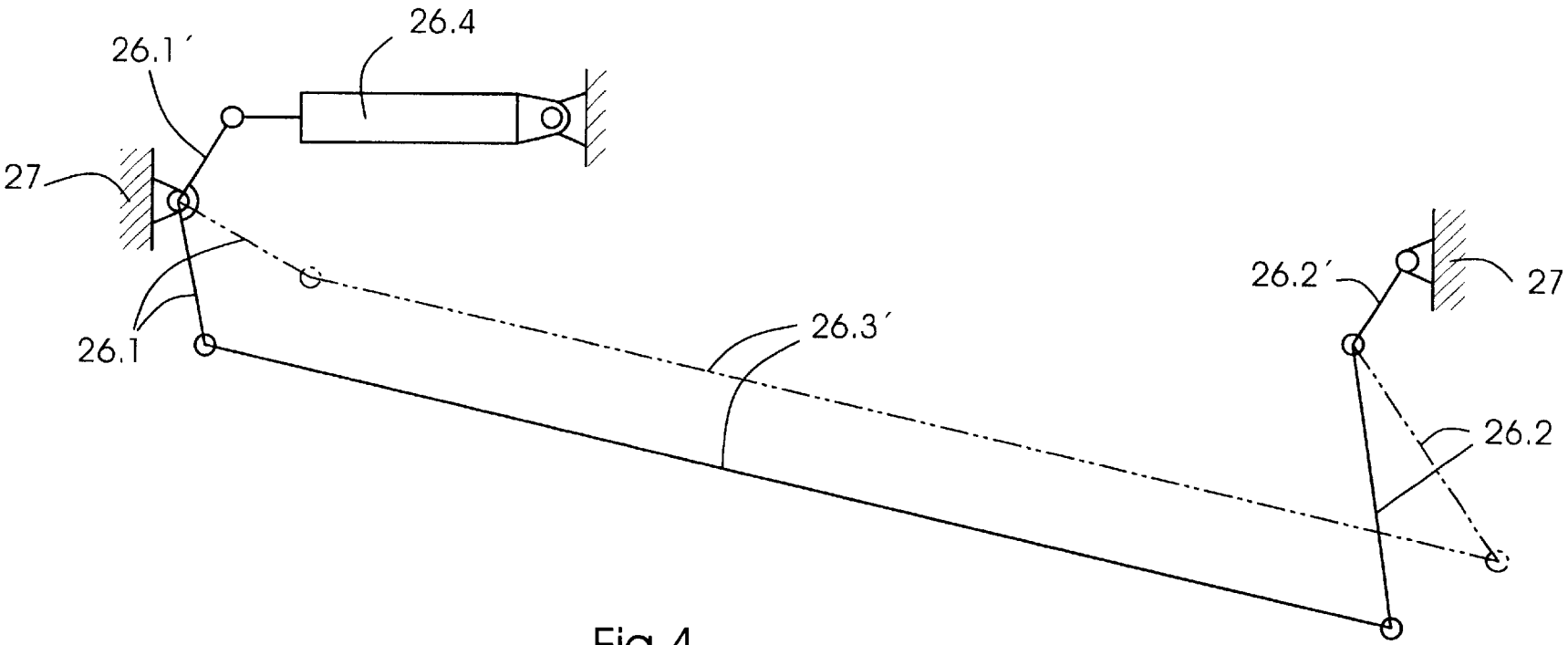
FIG. 4 is a schematic and diagrammatic view of another embodiment of the mechanism of FIG. 3 in a first position (in solid lines), wherein the first switching element determines one of the possible extents of the aforementioned first section of the gripper path, and in a second position (in phantom), wherein the first switching element assumes an ineffective or nonworking position, together with an example of a switching device by which the first switching element can be adjusted between the ineffective position thereof and a switching position wherein it determines the extent of the first section of the gripper path, to the downline end of which the sheets are dragged by the grippers.

In FIGS. 3 and 4, the schematic and diagrammatic view of the coupling mechanism 26 is illustrated for different positions of the first switching element 24 (see FIG. 2), which is reproduced here in simplified form as a straight coupling rod 26.3', omitting the switching surface 24.1 thereof provided to actuate the aforementioned roller lever device 25 to effect the opening of the grippers 9.1.

In the positions of the coupling mechanism 26 reproduced in FIG. 3, the first rocker 26.1 belonging thereto and arranged downline in the transport direction 5' maintains the position thereof, while the second rocker 26.2 arranged upline is able to change the position thereof by suitable adjustment of the joint thereof which is fixed to the frame. For this purpose, the first rocker 26.1 is attached to the side wall 27 of the delivery 1 by a joint fixed to the frame and this rocker 26.1, which can certainly in principle be pivoted about a locally-fixed first geometric axis 26.1", is held in a predetermined pivoting position by an actuating cylinder 26.4 (see FIG. 4); in the case illustrated by way of example, the first rocker 26.1 has an adjusting element in the form of a lever arm 26.1' which is extended beyond the articulation fixed to the frame, the extended lever arm 26.1' having a free end which is engaged by the actuating cylinder 26.4 (see FIG. 4) and holds the first rocker 26.1 in the aforementioned predetermined pivoting position.

The aforementioned change in the position of the second rocker 26.2 disposed upline, in the case of the stationary first rocker 26.1 presented in FIG. 3, is not performed during operation but results from an actuating operation explained hereinbelow, by which the time of the release of the sheets 3 which are supposed to form the sheet pile 14 is adjustable or, in other words, the aforementioned downline first end of the first section A1 of the gripper path, at which the sheets 3, which have been dragged until then by the respective grippers 9.1, are released to form the sheet pile 14. With the aforementioned actuating operation, parameters are taken into account which have a direct influence upon the formation of the sheet pile 14. These parameters include, in particular, the processing speed, the grammage and the stiffness of the processed sheets 3.

With the preferred construction of the first switching element 24 as a couple in the coupling mechanism 26, in order to adjust the aforementioned first end of the first section A1 of the gripper path in an advantageous manner, one of the adjusting capabilities of a coupling mechanism can be used, more specifically, in this regard, a displacement or adjustment of the position of a second geometric axis 26.2", about which the second rocker 26.2 is pivotable, a position of the first rocker 26.1, provided for the switching positions of the first switching element 24, being maintained.

Furthermore, according to a preferred refinement, the aforementioned second geometric axis 26.2" can be adjusted to geometric locations on a circular path and, after a corresponding adjustment in operation, maintains the position thereof, i.e., during an uninterrupted deposition of the sheets 3 on the sheet pile 14, the coupling mechanism 26 does not execute any movements, but rather, serves in this regard only for effecting a functionally or operationally-correct positioning of the first switching element 24.

With appropriate adjustment of the aforementioned second geometric axis 26.2", the first switching element 24 is then pivotable within a range of switching positions about a joint which attaches the switching element 24, i.e., the coupler 26.3, and, according to FIG. 3, the coupling rod 26.3', respectively, to the first rocker 26.1.

In order to implement or realize an appropriate pivoting movement, the second rocker 26.2 is attached or linked to a link 26.2' which, in turn, is attached to the side wall 27 so as to be fixed to the frame, and has a lever arm which projects beyond the locally-fixed joint thereof, can be pivoted within a pivoting range by an actuating device 28 and can be locked in a respective pivoting position.

The aforementioned second geometric axis 26.2" is to this extent determined by a joint connecting the second rocker 26.2 and the link 26.2' to one another.

For a manual adjustment of the pivoting positions of the first switching element 24 and the coupler 26.3, respectively, according to FIG. 3, by way of example, a screw mechanism is provided, in fact, having a first threaded rod attached fixedly to the frame and a second threaded rod attached to the aforementioned lever arm, the second threaded rod having two opposed thread pitches and an actuating nut cooperating with the threaded rods.

The coupling mechanism 26 including the first switching element 24 is attached fixedly to the frame and can be adjusted to different switching positions of the first switching element 24 within a given range. This range is indicated in FIG. 3 by two end positions of the first switching element 24, stylized here to form the coupling rod 26.3'. In conjunction with FIG. 1 or 2, i.e., in the case of the refinement of the switching surface 24.1 shown therein, this results in an earliest time for the release of the sheets 3 by the grippers 9.1 when the first switching element 24 assumes a switching position which, in qualitative terms, corresponds to the position of the coupling rod 26.3' illustrated in phantom, and a latest time in the case of a switching position of the first switching element 24 corresponding in qualitative terms to a position of the coupling rod 26.3' illustrated by a solid line.

It is believed to be readily apparent that, in the latter case, a sheet 3 is dragged along a longer section of the gripper path than in the first case.

The positions of the coupling rod 26.3' illustrated in FIG. 3, and those lying in between, correspond to selective switching positions of the first switching element, wherein the sheets 3 are released by the respective grippers 9.1 in order to form the sheet pile 14 upon the actuation of the aforementioned roller lever arrangement 25.

Instead of the manual adjustment by the actuating device 28 formed, by way of example, as a threaded drive in order to select a specific switching position of the first switching element 24, in a further refinement or improvement, an adjusting or setting device not illustrated in FIG. 3 is provided, which is actuatable by a motor. For this purpose, the link 26.2' is preferably pivotable by a shaft that is connected to a worm gear so as to rotate therewith and is mounted in the side wall 27, the worm gear being drivable by a motively rotatable worm for the duration of a respectively required number of revolutions and in the respectively required direction of rotation.

In FIG. 4, the coupling mechanism 26 is reproduced with solid lines in one of the selective switching positions of the first switching element 24 (see FIG. 2), i.e., in a switching position corresponding to a specific position of the coupling rod 26.3' within the aforementioned range of adjustment possibilities, the coupling mechanism being further reproduced in phantom, in an ineffective or inactive position of the first switching element 24 (See FIG. 2). Taking into account that the coupling mechanism 26 executes pivoting movements in a pivoting plane parallel to the side wall 27, and in conjunction with FIGS. 1 and 2, it is apparent that the first switching element 24 (see FIG. 2) can be adjusted from a switching position thereof, by being lifted with respect to the gripper path, into the ineffective or inactive position thereof, wherein no actuation of the roller lever arrangement 25 by the switching surface 24.1 takes place.

The actuating forces for adjusting the first switching element 24 between a switching position thereof and the ineffective or inactive position thereof and the reverse are introduced into the coupling mechanism 26 via the first rocker 26.1. To this end, the first rocker 26.1 has a lever arm 26.1' which extends beyond the location of fixed attachment thereof to the frame and whereon an actuating cylinder 26.4 preferably attached to the side wall 27 and fixed to the frame acts and, in the representation thereof in FIG. 4, keeps the first switching element 24 and the coupling rod 26.3', respectively, in a switching position.

As FIG. 2 further shows, a second switching element 29 is disposed downline from the switching surface 24.1 with respect to the transport direction represented by the arrow 5', this second switching element 29 serving to define a second end of a second section A2 of the gripper path, disposed downline from the downline end of the aforementioned first section A1 of the gripper path. For this purpose, the second switching element 29 is likewise equipped with a switching surface 29.1 which, in a switching position thereof, makes contact with the roller 25.1 of the aforementioned roller lever arrangement 25 (note FIG. 2) and, therefore, opens the grippers 9.1. At this end of the second section A2 of the gripper path, which is longer than the first, the second switching element 29, in the switching position thereof, actuates the aforementioned roller lever arrangement 25 with the effect of opening respective grippers 9.1. In the ineffective position of the first switching element 24, the sheets 3 are in this case delayed with respect to the release thereof to form the sheet pile 14, i.e., are released farther downline with respect to the transport direction, thus, at the end of the aforementioned second section of the gripper path. The sheets 3 released in this way no longer strike the aforementioned leading-edge stops 12; instead, they can be removed by using further braking and guide devices, and can be supplied to a deposit device 30, for example, for proof sheets or rejects, disposed downline with respect to the sheet pile 14.

The respective downline end of the first and second sections A1 and A2, respectively, of the gripper path through which the grippers 9.1 travel from the acceptance of a respective sheet 3 from the impression cylinder 2.1 until the release of the sheet at least approximately coincides with contact points K1 and K2, respectively, wherein the roller

25.1 makes contact with the switching surfaces 24.1 and 29.1, respectively, and thus opens the respective grippers 9.1. The position of the contact point K1, wherein the roller 25.1 makes contact with the switching surface 24.1, results from a switching position, adjusted as discussed, of the first switching element 24 corresponding to a specific position of the coupling rod 26.3' within the adjustment range thereof indicated in FIG. 3. The contact point K1 for one of the possible positions is reproduced in FIG. 2.

As explained hereinbelow, the second switching element 29 is in a switching position permitting the removal when the first switching element 24 is located in the ineffective position thereof, whereas the first switching element 24 is located in a switching position thereof when the second switching element 29 assumes an ineffective position. Although it is not absolutely necessary to bring the second switching element 29 into the ineffective position thereof with regard to the functions of the two switching elements 24 and 29, it advantageously acts in a manner to reduce switching noises and wear of the second switching element 29 and of the roller lever arrangement 25 and, secondly, as in the exemplary embodiment at hand, is provided when the second switching element 29 takes up space in the switching position thereof which is taken up by the first switching element 24 in the switching position of the latter.

The coupling mechanism 26 provided for adjusting the first switching element 24 is a first dividing gear mechanism belonging to a joint and cam mechanism, by which the two switching elements 24 and 29 are adjustable.

Figure 5:
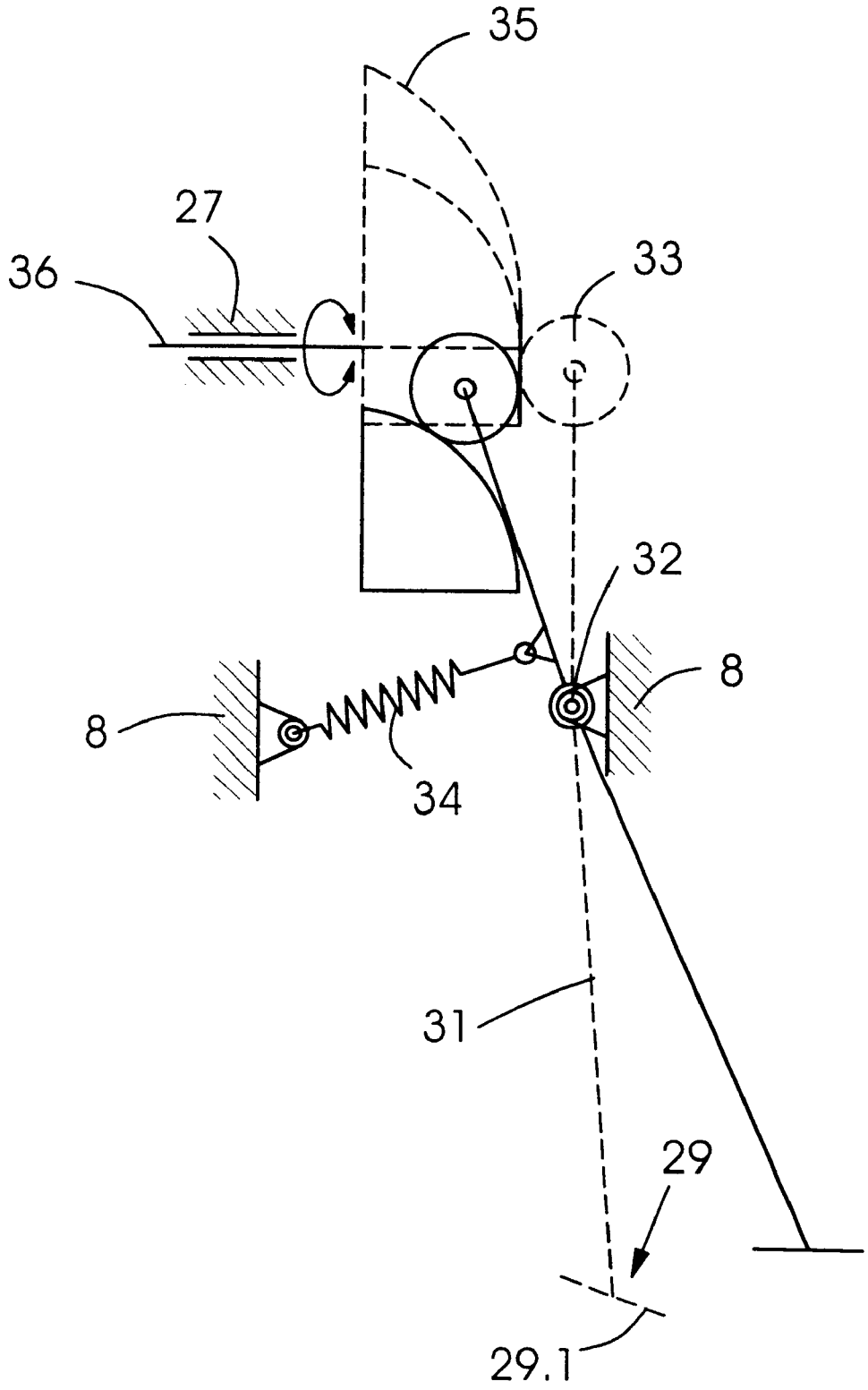
FIG. 5 is a diagrammatic and schematic view of an axial cam-bearing mechanism element belonging to the first divider gear mechanism in conjunction with a further divider gear mechanism, by which the second switching element is adjustable by the axial cam, with appropriate adjustment of the first divider gear mechanism, between an ineffective or nonworking and a switching position, wherein, in the latter position, the second switching element, with the first switching element in the ineffective position, determines the extent of the second section of the gripper path, to the downline end of which the sheets are dragged by the grippers.

FIG. 5 is a diagrammatic and schematic view of a further dividing gear mechanism belonging to this joint and cam mechanism in the form of a cam mechanism connected to the second switching element 29, more specifically illustrated with solid lines in the switching position of the second switching element 29, and in phantom in the ineffective position of the second switching element 29.

The second switching element 29 is carried by a swinging or pivot arm 31. The pivot arm 31 is mounted on a pin 32 which, in turn, is accommodated in the deflection rail arrangement 8, which represents a guide part, determining a section of the course of the gripper path, for one of the conveyor chains 6, and includes a deflection section here. The pin 32 is accommodated in this guide part so that the pivot arm 31 can be pivoted in a plane perpendicularly to the pivoting plane of the coupling mechanism 26, which is represented in FIG. 5 by the track of the pivoting plane reproduced by a broken line in the surface of the drawing, parallel to the surface of the drawing, so that the second switching element 29 is located in the switching position thereof in a first pivoting position and is located in the ineffective position thereof in a second switching position, the second switching element 29 being adjustable into the ineffective position from the switching position by being moved laterally off the gripper path.

In order to adjust the second switching element 29 between the switching position thereof and the ineffective position thereof and the reverse, the pivot arm 31 carrying the switching element 29 at a first end thereof is provided at a second end thereof with a cam follower, here in the form of a roller 33 rotatably mounted on the pivot arm 31. On the pivot arm 31, there acts a spring 34 which is attached, in a manner not specifically illustrated, to the deflection rail device or arrangement 8, and biases the roller 33, i.e., the pivot arm 31 at the end thereof carrying the roller 33, in a direction towards a control cam 35, and therewith biases the second switching element 29 in the direction towards the switching position thereof. The control cam 35 is formed as an axial cam which, together with the first rocker 26.1 of the coupling mechanism 26, can be adjusted and, to this end, is connected to a shaft 36 so as to fixed against rotation relative thereto, the shaft 36, in turn, being connected to the first rocker 26.1 so as to rotate therewith and representing a component for attaching the first rocker 26.1 to the side wall 27 so that the first rocker 26.1 is fixed to the frame. The control cam 35 can therefore be adjusted while adjusting the first switching element 24.

The first switching element 24 and the second switching element 29 have a kinematic connection to this extent, specifically in a way that the second switching element 29 can be adjusted while adjusting the first switching element 24. In this case, the control cam 35 is constructed in a manner that the second switching element 29 is in the ineffective position thereof when the first switching element 24 assumes a switching position, and that an adjustment of the first switching element 24 from a switching position thereof into the ineffective position thereof adjusts the second switching element 29 from the ineffective position thereof into the switching position thereof, and an adjustment of the first switching element 24 from the ineffective position thereof into a switching position adjusts the second switching element 29 from the switching position thereof into the ineffective position thereof.

As shown in FIG. 2, this kinematic connection is maintained even when the conveyor chains 6 have to be retensioned as a result of a lengthening of the latter. The deflection rail arrangement 8 provided instead of a deflection sprocket in the case at hand and forming an outer chain guide path 8.1 and an inner chain guide path 8.2 is provided with elongated holes 37 for the purpose of retensioning a conveyor chain 6 guided by the paths, screws 38, by which the deflection rail arrangement 8 can be fixed to the side wall 27, passing through the elongated holes 37. When the screws 38 are loosened, the elongated holes 37 permit adjustment of the deflection rail arrangement 8 with the effect of tensioning a conveyor chain 6. In order to maintain the kinematic connection between the two switching elements 24 and 29, the roller 33 cooperating with the control cam 35 attached to the side wall 27 via the shaft 36 so as to be fixed to the frame has a length and a position, with respect to the control cam 35, so that the roller 33 makes contact with the control cam 35 as far as the end of a retensioning travel of the deflection rail arrangement 8 with respect to the side wall, which corresponds to a yet permissible lengthening of the conveyor chain 6.

We claim:

1. In a sheet-processing machine, a delivery comprising a frame, grippers revolvable, during operation, along a gripper path within said frame, said grippers serving for seizing a respective one of the sheets at a location on said gripper path and for dragging the sheet along sections of said gripper path in a transport direction, a first switching element, by which a first end of a first one of said sections of said gripper path, disposed downline with respect to said transport direction, is definable, and a second switching element, by which a second end of a second section of said gripper path, disposed downline with respect to the end of the first section, is definable, said first switching element being disposed on said frame, and said second switching element being disposed on a guide part fixed to said frame, and serving for determining a section of a course of said gripper path.

2. The delivery according to claim 1, wherein said switching elements are adjustable between a respective switching position and a respective ineffective position and the reverse.

3. The delivery according to claim 2, wherein one of said two switching elements is in said switching position thereof when the other of said two switching elements is adjusted into said ineffective position thereof, and the reverse.

4. The delivery according to claim 2, wherein said first switching element is adjustable from said respective switching position thereof into the respective ineffective position by being liftable with respect to the gripper path, and said second switching element being adjustable from the respective switching position into the respective ineffective position by being movable laterally off the gripper path.

5. The delivery according to claim 1, including a coupling mechanism attached to said frame, said coupling mechanism having a coupler forming said first switching element.

6. The delivery according to claim 5, wherein said coupling mechanism includes a first rocker pivotable about a locally fixed, first geometric axis and a second rocker pivotable about a second geometric axis and having a position that is adjustable.

7. The delivery according to claim 6, wherein said second geometric axis is adjustable to geometric locations on a circular path.

8. The delivery according to claim 1, including a pivot arm attached to said guide part and carrying said second switching element.

9. The delivery according to claim 2, wherein said switching elements are connected kinematically to one another.

10. The delivery according to claim 9, including a spring for biasing said second switching element with an actuating force in a direction towards said switching position thereof, and a control cam adjustable while said first switching element is being adjusted, and by which said second switching element is adjustable from said switching position thereof into said ineffective position thereof counter to said actuating force and, under the action of said actuating force, is adjustable from said ineffective position thereof into said switching position thereof.

11. The delivery according to claim 1, wherein said frame has a side wall.

12. The delivery according to claim 1, wherein said guide part is a deflection rail arrangement.

* * * * *